United States Patent [19]

Woodard et al.

[11] Patent Number: 4,832,756

[45] **Date of Patent: * May 23, 1989**

[54] CONTROLLING DISTORTION IN PROCESSED BERYLLIUM COPPER ALLOYS

[76] Inventors: Dudley H. Woodard, 35188 N. Turtle Trail, Willoughby, Ohio 44094; Lynn J. Ebert, deceased, late of Euclid, Ohio; by Mary K. Ebert, executrix, 104 E. 197th St., Euclid, Ohio 44119

[ * ] Notice: The portion of the term of this patent subsequent to Sep. 17, 2002 has been disclaimed.

[21] Appl. No.: 164,481

[22] Filed: Mar. 4, 1988

Related U.S. Application Data

[63] Continuation-in-part of Ser. No. 62,703, May 22, 1987, which is a continuation-in-part of Ser. No. 756,044, Jul. 17, 1985, Pat. No. 4,579,603, which is a continuation-in-part of Ser. No. 713,318, Mar. 18, 1985, Pat. No. 4,541,875.

[51] Int. Cl.[4] ..... C22F 1/04

[52] U.S. Cl. ..... 148/11.5 C; 148/12.7 C; 148/20

[58] Field of Search ..... 148/12.7 C, 20, 11.5 C

[56] References Cited

U.S. PATENT DOCUMENTS

| | | | |
|---|---|---|---|
| 3,658,601 | 4/1972 | Britton et al. | 148/20 |
| 4,541,875 | 9/1985 | Woodard et al. | 148/11.5 C |
| 4,565,586 | 1/1986 | Church et al. | 148/12.7 C |
| 4,579,603 | 4/1986 | Woodard et al. | 148/12.7 C |
| 4,594,116 | 6/1986 | Inagaki | 148/12.7 C |
| 4,724,013 | 2/1988 | Church et al. | 148/12.7 C |

*Primary Examiner*—Upendra Roy

[57] ABSTRACT

This invention provides a novel method for the production of reproducible parts formed from beryllium copper alloys. More specifically, the invention provides a process for the production of mill hardened beryllium copper strip, wire, rod or tubing with improved mechanical properties from which formed parts can be age hardened in a reproducible manner to give minimal distortion and improved mechanical properties over a broad range of temperatures. To this end the process comprises a series of mechanical and thermal treatments which minimize or eliminate non-reproducible distortion by decreasing the magnitude of the residual stresses throughout the various steps of the process before the formation of precipitates becomes the dominant mechanism and by providing a more even patterned distribution of precipitates in the matrix of the alloy both prior to and after a thermal aging process. The implementation of this process, in conjunction with a precipitation hardening treatment utilizing a molten heating medium, results in an alloy which exhibits an increased elongation in tandem with an increased yield stress.

16 Claims, 3 Drawing Sheets

CONTROLLING DISTORTION IN PROCESSED BERYLLIUM COPPER ALLOYS

FIELD OF THE INVENTION

This application is a continuation-in-part of application Ser. No. 062,703 filed May 22, 1987, which, in turn, is a continuation-in-part of application Ser. No. 756-044, filed July 17, 1985, now U.S. Pat. No. 4,579,603, which, in turn, is a continuation-in-part of application Ser. No. 713-318, filed Mar. 18, 1985, now U.S. Pat. No. 4,541,875. These disclosures are incorporated herein by reference.

This invention relates to the processing of beryllium copper alloys. More specifically, this invention relates to the production of mill hardened beryllium copper strip, wire, rod and tubing which by themselves or in parts formed from them can be age hardened in a reproducible manner to show minimal distortion and improved mechanical properties.

BACKGROUND OF THE INVENTION

The prior art reveals various methods for decreasing the distortion which results during the precipitation hardening of formed parts produced from beryllium copper alloys. Unfortunately, some of these prior art methods are only partially effective and often fail to minimize the resultant distortion to a commercially acceptable degree. Additionally, all of the prior art methods yield inconsistent non-reproducible results. These alloys are used in electrical connectors where reproducible dimensional, mechanical and electrical properties in the finished product are important if zero defects are to be obtained by the end user.

Basically, all prior art methods for producing precipitation hardened formed parts from beryllium copper alloys include the general combination of the following sequence of processing events: preparing a beryllium copper melt; casting the melt; hot working the cast alloy; solution annealing the alloy; cold working the solution annealed alloy; forming parts from the cold worked alloy; aging the cold worked beryllium copper. Various modifications have been developed in an attempt to minimize the non-reproducible dimensional and mechanical changes experienced in this processing sequence. The product of the general combination above or any of the modifications thereto will be termed broadly a processed beryllium copper alloy.

In this connection, reference is made to the methods disclosed in Guha U.S. Pat. No. 4,657,601; Inagaki U.S. Pat. No. 4,594,116; Woodard U.S. Pat. No. 4,579,603; Woodard U.S. Pat. No. 4,541,875; Rotem U.S. Pat. No. 4,533,412; Goldstein U.S. Pat. No. 4,425,168; McClelland U.S. Pat. No. 4,394,185; Wickle U.S. Pat. No. 4,179,314; Shapiro U.S. Pat. No. 3,882,712; Vernier U.S. Pat. No. 3,682,712; Chin U.S. Pat. No. 3,663,311; Britton U.S. Pat. No. 3,658,601; the article entitled "Residual Stresses in Copper—2% Beryllium Alloy Strips", authored by K. E. Amin and S. Ganesh, *Experimental Mechanics,* December 1981, page 474; the article entitled "A Technique for Predicting Distortion and Evaluating Stress Relief in Metal Forming Operations", authored by K. E. Amin and R. M. Rusnak, *Journal of Metals,* February 1981; the article entitled, "Stress Relaxation in Bending of Copper Beryllium Alloy Strip", authored by A. Fox in *Journal of Testing and Evaluation,* Vol. 8, No. 3, May 1980; the article entitled "Metallurgical Phenomena in High Strength Beryllium-Copper Alloys Which Affect Electrical Component Design", authored by John Ballance in 1Oth Annual Connector Proceedings, 1977; the article entitled, "Schrumpfung and Verzug bein Aus Harten von Kupfer Beryllium Legierungen", authored by H. Kreye, H. Noeka and F. Terline in *Metall,* 2 Jahrgang, November 1975; and the article entitled, "Precipitation Hardening in Cu 1.81% BE 0.28% Co" authored by W. Bonfield and B. C. Edwards in Journal of Materials Science, Vol. 9, 1974, page 406. The methods disclosed in these prior art sources are only partially successful in minimizing and making more reproducible the distortions in precipitation hardened finished products.

Kreye, Ballance, Bonfield and Edwards and others have shown the correlation between the shrinkage in strip and wire that occurs on aging and the decrease in volume due to the formation of the GuinierPreston zones and the gamma precipitates. To date, no one has presented evidence which demonstrates that the rate of formation of these G.P. zones and $\gamma''$, $\gamma'$ or $\gamma$ precipitates is different, when they are formed under compressive residual stresses, from the rate at which they are formed under tensile residual stresses. If it can be shown that the rates were dependent upon the stress system under which they occur, a lack of reproducibility in the residual stress patterns created during the forming of beryllium copper primary products and parts would mean a lack of reproducibility in the shrinkage created by the aging process. This would explain why it has been found that a decrease in the magnitude of the residual stresses results in a decrease in the magnitude of the non-reproducible shrinkage that occurs on aging. This application describes those techniques which will decrease the magnitude of the residual stresses, minimize the differences between the rates of formation of precipitates under tensile and compressive residual stresses and thus lead to the formation of mill hardened beryllium copper strip, wire, rod and tubing and parts formed from them that can be age hardened in a reproducible manner to give improved mechanical properties.

Amin and Rusnak have correctly identified residual stresses as one of the sources of distortion. Amin and Ganesh have also shown that a high rolling reduction of beryllium copper strip results in tensile residual stresses near the surface of the strip and compressive residual stresses at the center of the strip while low rolling reductions result in the opposite location of these stresses within the strip. The ability to create a reversal in the patterns of tensile and compressive residual stresses will be used to define the differences between heavy and light reductions. The results from Kreye et al. can be interpreted as showing that an irregular reduction, such as would result in bandoliered wire from hammer forging, will remove any such residual stress patterns in beryllium copper, particularly if the strokes are alternately light and heavy.

The Goldstein and the McClelland patents comprehend the importance of relieving residual stresses prior to the forming operation by the incorporation of a pre-aging technique. However, they fail to realize that in a thermal treatment, such as their pre-aging techniques, two reactions occur simultaneously. On the one hand, thermal treatments such as pre-aging reduce the magnitude of the existing cold working and residual stress patterns that affect the precipitation hardening. On the other hand, these treatments also promote the nucleation and growth of the precipitates formed during precipitation hardening. Fox has shown that in beryllium copper, stress relaxation and precipitation hardening can occur simultaneously at the same temperature. We have found that: the recognition of these competing mechanisms is critical in the development of reproducible softening and hardening techniques and the effects thereof on the formation of reproducible formed parts. That is, all thermal treatments must utilize those combinations of times, temperatures and heating rates that relieve or decrease the magnitude of residual stresses before the formation of precipitates become the dominant mechanism. This is illustrated in FIG. 1, and is discussed further hereinafter.

Chin teaches a process for obtaining an increase in yield strength and modulus of elasticity as well as an increase in formability for the phosphor bronze and cupro-nickel alloys. However, he failed to recognize that while he obtained similar increases in yield strength and modulus of elasticity for the beryllium copper alloys, his resultant lack of increased formability was due to his slow rate of heat up in the annealing step which followed the high reduction.

Ebert has taught that the increases in yield strength described by Chin are due to a decrease in the magnitude of the residual stresses. This he has done by showing that, based on the assumption of equal intensities of peak tension and compression residual stresses, the presence of compressive and tensile residual stresses create a drop in the yield strength and that, conversely, a decrease in the magnitude of these residual stresses increases the yield strength.

Ebert then attributes the increases in the yield strength and modulus of elasticity for beryllium copper, as shown in Chin's FIGS. 5 and 6, as being due to the decrease in the relative magnitudes of the residual stresses. These decreases are caused by the high strain reductions of over 85% as well as by the 2-hour anneals at temperatures ranging from 100° F. to 525° F. As is well known, these decreases in the magnitudes of the residual stresses occur at those temperatures and times which crete only minimal precipitation hardening. As will be shown in our Example 1, the decrease in residual stresses, before precipitation hardening becomes the dominant mechanism, is an important factor in creating beryllium copper primary products and parts that can be age hardened in a reproducible manner.

Part of the increase in the yield strength and formability of the nickel-rich beryllium copper alloys, as taught by Rotem, Inagaki and Guha, can be attributed to this decrease in the magnitude of the residual stresses. However, they do not indicate that this effect is a rate dependent phenomenon which can be improved by a fast heat up in the precipitation hardening step which follows their high reductions. This improvement in mechanical properties created by the increase in the heating rate will be shown in our Example 1.

None of the prior art teachings recognize that the rates at which the nucleation and growth of precipitates occur are different when the beryllium copper matrix is precipitation hardened under tensile residual stresses as opposed to compressive residual stresses. It has been shown that the formation of the gamma precipitates create shrinkage in the matrix as well as in the precipitates themselves. The formation of the G.P. zones and gamma precipitates result in a decrease in their volume from that of the solid solution. As the Be atoms diffuse out of the solid solution towards the G.P. platelet nuclei, the surrounding volume decreases. Then, it can be expected that the driving force for this diffusion should be different in a region where the lattice strains are decreased because they are under compression from that in a region where the lattice strains are increased under tensile residual stress.

Bonfield and Edwards have interpreted the actions of abutting G.P. zones, that are described by Phillips and Tanner, as indicating that the stress fields surrounding one zone produces cooperative interaction of adjacent zones to minimize the tensile and compressive residual stresses imposed on the matrix. While the magnitude of the unique effects of the G.P. zones on the mechanical properties of the beryllium copper alloys are recognized as being abnormally large, the role of residual stresses in the rate of formation of these zones has been totally ignored.

Also, what has not been recognized by the prior art is the existence of precipitate patterns, created during the post hot forming, cold forming and precipitation hardening operations by these differences in the rate of their formation. If there is a precipitate pattern, then when the precipitates are given the normal short time anneal, there will be left a residual pattern of concentrates of beryllium atoms and undissolved precipitates as well as reduced residual stresses. This residual pattern could form the basis for the memory, which becomes evident on aging, that the formed part has of its thermal and mechanical history. Evidence will be presented in Example 1 which shows that this memory can be minimized by the formation of an opposite pattern created by the second reduction and annealing taught herein.

The precipitate part of this memory can also be minimized by the short time high temperature anneal taught herein while the residual stress part of this memory can be minimized by the fast heat up of the alloy after a controlled high reduction step also taught herein. It is recognized that by the time that large non-coherent precipitates are formed, most of the effective residual stresses have vanished. However, the effects of this memory carry over during the formation of such non-coherent precipitates. In Example 3, the existence of such a memory will be confirmed and it will be shown how such a memory can be used to improve the offset yields in rolled strip.

If different contiguous volumes in a region of a beryllium copper part have different amounts of precipitates, these volumes will deform at different rates depending upon the relative size and number of their precipitates. That is, they will have different rates of work hardening. What has not been realized before is that the existence of precipitate patterns in beryllium copper created by the prior mechanical and thermal histories in the strip or wire, with their resultant differences in the rates of work hardening in different volumes, would make the beryllium copper shapes strain rate sensitive during cold forming operations. Further precipitation hardening would then increase such strain rate sensitivity. Until our test results have been described in Example 2, such strain rate sensitivity and its accompanying increase after precipitation hardening has not been recognized as existing in beryllium copper alloys nor any process developed to minimize the effect of this sensitivity on its mechanical properties.

In the extrusion of rod and in the rolling of strip of a strain rate sensitive material, it has been observed that at certain combinations of line speeds, reductions and die or roll diameters, regions of turbulence are carried through the die or between the rolls. The result is a lack of uniformity in the thickness and therefore in the amount of reduction created in the cold-rolled strip or wire. Minimizing these volumes of severe turbulence in such strip or wire would cause a more laminar flow condition and thus create a more uniformly thick strip or wire especially after aging. This is of importance to the production engineer. Then the more uniform the reduction along the length of the beryllium copper strip or wire, the more uniform would be the residual stress patterns set up along such strip or wire.

All these facts mean that to date there has been no application of (1) the effects of light and heavy reductions, (2) the minimizing of turbulence during cold forming, or (3) after a short time high temperature anneal, the severe reduction of the primary products followed by a low temperature rapid aging, to the minimizing and leveling out of the magnitude of the residual stresses within the primary products or to the minimizing of residual stresses set up within the alloy parts by such processes as forming, slitting, broaching, and machining. Once the importance of controlling the rate of precipitation and controlling the magnitude and rate of formation of residual stresses after the cooling operation are all recognized, it becomes possible by one skilled in the art to make those adjustments during and after hot forming that minimize the precipitate patterns.

With the foregoing in mind, it is a principal object of this invention to provide a process for relieving the magnitude of the residual stresses in beryllium copper alloys before the formation of precipitates becomes the dominant mechanism.

Another object of this invention is to provide a process for imposing on regions of compressive or tensile residual stress those tensile or compressive residual stresses that are of the opposite type.

Yet another object of this invention is to provide a process which makes more uniform the residual stresses of the reproducibly age hardenable primary products and thereby makes more reproducible the aging characteristics of parts that are machined, stamped or cold forged from such beryllium copper strip, wire, rod or tubing. Another object of this invention is to provide a process which minimizes the strain rate sensitivity of beryllium copper alloys through all stages of cold working and precipitation hardening.

Still another object of this invention is to provide a process which will result in a beryllium copper alloy which when aged exhibits an increased yield stress in tandem with an increased elongation.

Another object of this invention is to provide a process which improves the stress relaxation, the fatigue life and the high temperature properties of parts formed from reproducibly age hardenable strip, wire, rod or tubing.

Still another object of this invention is to provide a process which will minimize the effects of rolling, drawing, slitting or machining on the residual stresses created prior to aging regardless of the prior thermal and mechanical history of the part.

A further object of this invention is to provide a process for the virtual elimination of the non-reproducible part of the distortion which is currently experienced during the production of aged formed parts made from beryllium copper alloys.

SUMMARY OF THE INVENTION

These and other objects of the present invention may be achieved by including in the prior art process for producing formed parts from a beryllium copper alloy the additional improved steps of: subjecting the alloy to a heavy rolling reduction of over 25% with minimal turbulence, in some uses over 45% is desirable during the final cold rolling step, solution annealing the alloy, subjecting the alloy to a low rolling reduction of from 5% to 15% with minimal turbulence, once again solution annealing the alloy, followed by work hardening the alloy; or, as alternate steps, cold rolling or drawing the alloy to a reduction of over 91% with minimal turbulence after a high temperature anneal at 1725° F. to 1850° F. for a period of up to 300 minutes, subjecting the alloy to a thermal treatment in a molten heating medium at a temperature of from 300° F. to 800° F. for a period of up to 300 minutes, and when possible reversing the direction of coiling during each of the various steps of the process; forming the part and thereafter subjecting the part to a thermal treatment in a molten heating medium at a temperature of from 300° F. to 800° F. for a period of up to 300 minutes.

To the accomplishment of the foregoing and related ends the invention, then, comprises the features hereinafter fully described and particularly pointed out in the claims. The following description setting forth in detail certain illustrative embodiments of the invention, these being indicative, however, of but a few of the various ways in which the principles of the invention may be employed.

IN THE DRAWING

DESCRIPTION OF PREFERRED EMBODIMENT

Figure 1:
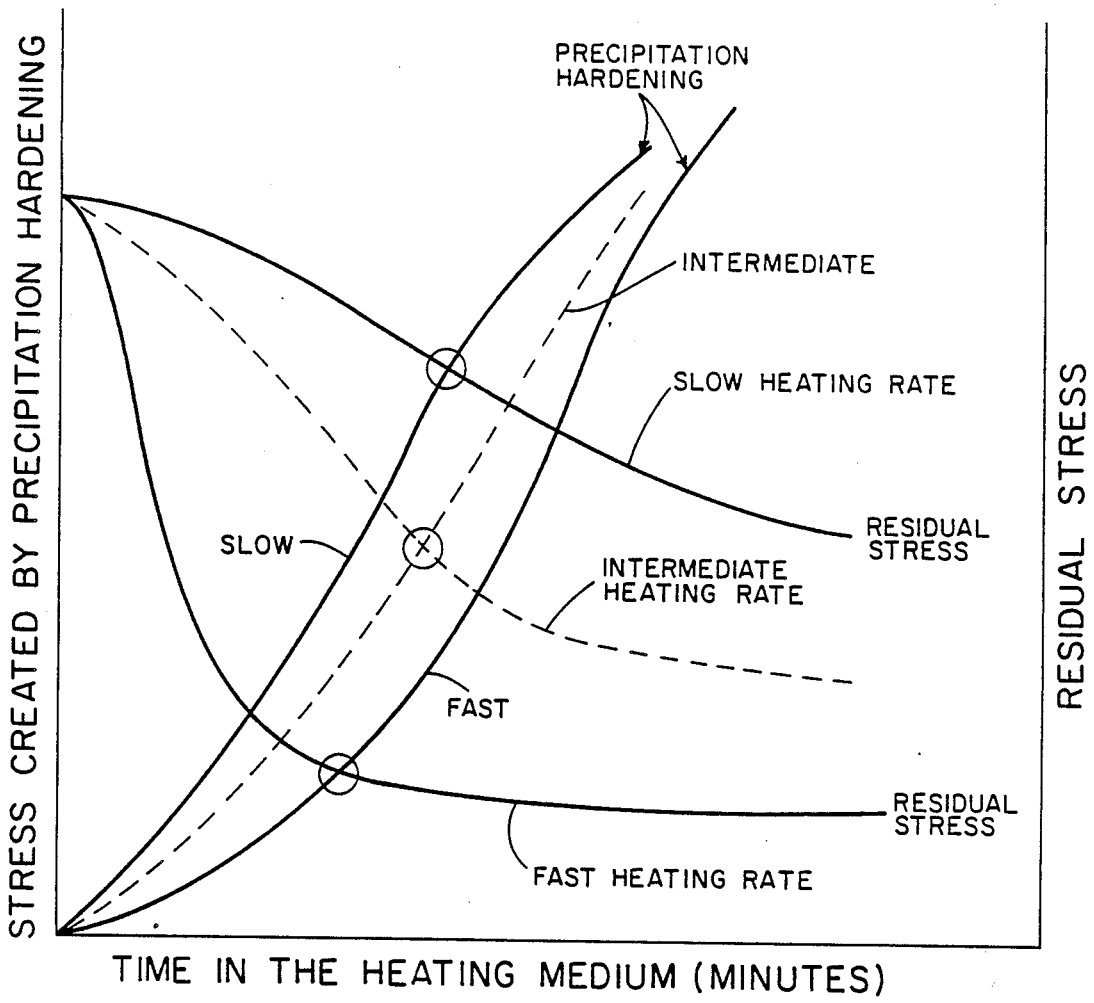
FIG. 1 is a generalized illustration of the residual stress in a specimen versus time at the thermal treatment temperature overlayed by the stress developed from the coincidental precipitation hardening of that specimen at a fast, an intermediate and a slow heat-up rate.

Residual stresses, both compressive and tensile, are created in wire and strip during the various forming operations such as rolling, coiling, drawing, stamping, machining, shaping, slitting and the like. In an attempt to better understand the effects which these stresses impart into the alloy when it is aged, tests were conducted in which segments of beryllium copper strip were bent around an anvil of a specific radius of curvature and then aged. Upon aging, the angle formed by the bent strip was found to change in a non-reproducible manner. The effects of altering the radius of the anvil, the angle of the bend, the side of the strip being put under compression, the thickness of the strip, and the thermal treatment given the strip prior to aging, were all studied and the results statistically evaluated. These statistical evaluations revealed that on aging, the amount of shrinkage in regions that were under compressive residual stress was different from the amount of shrinkage that occurred in regions than were under tensile residual stress.

These observations, when combined with the fact that shrinkages occur in formed beryllium copper parts during aging due to the nucleation and growth of precipitates, led the inventors to the conclusion that upon thermal aging the rate of nucleation and growth of precipitates in regions that are under compressive residual stress is different from the rate that is created in regions that are under tensile residual stress. Therefore, during the aging of a formed part, which contains various regions of compressive and tensile residual stresses, the formation of precipitates will proceed at different rates in each of these types of regions resulting in different amounts of shrinkage from region to region and thus will create distortion.

EXAMPLE 1

Evidence of the existence of such regions containing uneven amounts of precipitates after aging was supported by data obtained from tests performed on coils of beryllium copper wire. Prof. Baldwin, in his Edgar Marburg Lecture to the ASM in 1949, showed how the pattern of residual stresses in drawn wire changes from compressional to tensile components as we go from low reductions to high reductions and vice versa. It is known that certain variations in the wire drawing process of steel can give uniform tensile properties and yet leave cyclic variations in the pattern of the compressive and tensile residual stresses. Initial tests on beryllium copper wire, which had been given the standard processing, showed that such wire had relatively uniform mechanical properties in the cold drawn ¼ H or ½ H condition.

However, in tests on sequential segments of wire from this same coil, it was observed that in the section of the coil of wire that had been aged at 600° F. when in the ¼ or ½ H condition, some segments of the coil periodically showed much higher yields and lower elongations. These can be shown to result from increases in the rates of work hardening caused by increases in the amount of precipitates present in such segments. Metallographic examination showed that all samples along the length of wire that were polished before aging had the same grain size, the same amount and size of beryllides and the same amount of grain boundary precipitates. The fact that the hardness values before aging were relatively uniform across the transverse section seems to eliminate the possibility that differences in surface strain created these differences in mechanical properties.

The tensile tests on wire also revealed that when segments drawn from the same original coil that were in the ¼ H or ½ H condition were given a severe cold reduction, annealed, given a slight cold reduction, annealed again and then given a further cold reduction, there were no segments that revealed high work hardening rates either before or after aging. This meant that the distribution of precipitates, formed in this age hardenable wire by further aging, was more even throughout the aged coil and that the cyclic pattern of regions in which there were excessive amounts of precipitates, no longer existed. This coil we consider as reproducibly age hardenable and in a mill hardened condition.

In an attempt to further understand and develop methods for controlling the effects of these precipitate patterns, additional tests were conducted. In one of these tests two contiguous segments of 25 alloy wire were given a severe cold reduction, annealed, given a slight cold reduction, and then annealed. The segments were then drawn to the ¼ H condition and separate lengths were aged in either an air atmosphere furnace or a salt bath at 600° F. prior to being water quenched. The tensile data obtained from these reproducibly age hardened specimens is shown below:

TABLE 1

| Time | Proportional Limit KSI | | Elongation (Percent) | |
|---|---|---|---|---|
| Minutes | Furnace | Salt | Furnace | Salt |
| 0 | 74.2 | | 10.1 | |
| 2 | 76.9 | 73.1 | 9.8 | 22.0 |
| 5 | 85.8 | 79.0 | 8.3 | 17.5 |
| 10 | 108.0 | 98.4 | 6.3 | 12.8 |
| 15 | 132.9 | 131.5 | 1.8 | 8.2 |
| 2% 15* | | 118.5 | | 6.6 |

*Two minutes in the salt bath followed by a water quench and 15 additional minutes in the salt bath.

Analysis of these results shows that the furnace aging while increasing the proportional limit was totally ineffective in improving the elongation of the reproducibly age hardenable wire. However, for the reproducibly age hardenable wire that was quickly heated in the salt bath, two minutes was long enough to decrease the residual strains and the cold work put in the wire by the quarter-hard reduction with the result that the proportional limit was decreased and the elongation was more than doubled from 10.1 to 22.0. After two minutes, however, the precipitation phenomena became the dominant mechanism and strengths began to increase and elongations began to drop. After ten minutes in the salt bath, the wire revealed more elongation than it had originally shown before aging and a 32.7% increase in the proportional limit. Therefore, clearly a hardening treatment of five to ten minutes in a 600° F. molten salt bath will increase the formability of the reproducibly age hardenable wire as well as the strength of such wire. Similar increases in the proportional limit and increases in elongation were observed in specimens treated in a salt bath at 550° F. for less than 15 minutes and at 700° F. for less than 45 seconds.

From the results in Table 1 it is apparent that the fast heat up in the salt bath gave, for any specific aging time, a decreased proportional limit and an increased elongation when compared to the air heated specimens. Since the rate of heat transfer was greater for the salt bath, it is evident that the average magnitude of the residual stresses throughout the cross-section of the wire was reduced faster in the salt bath than in air. That is, the stress relief phenomena was more uniformly dominant in the salt bath aged specimens.

Figure 2:
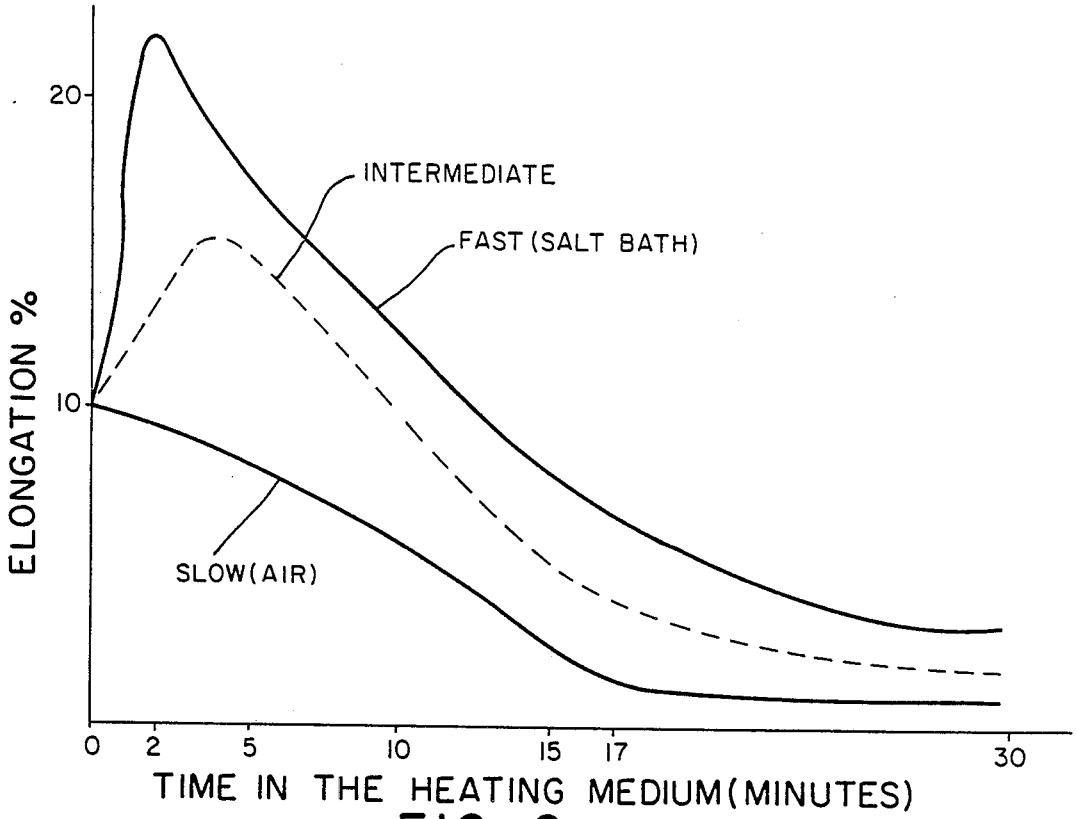
FIG. 2 is a plot of percent elongation versus time in the heating medium. This graph is described below in Example 1.
Figure 3:
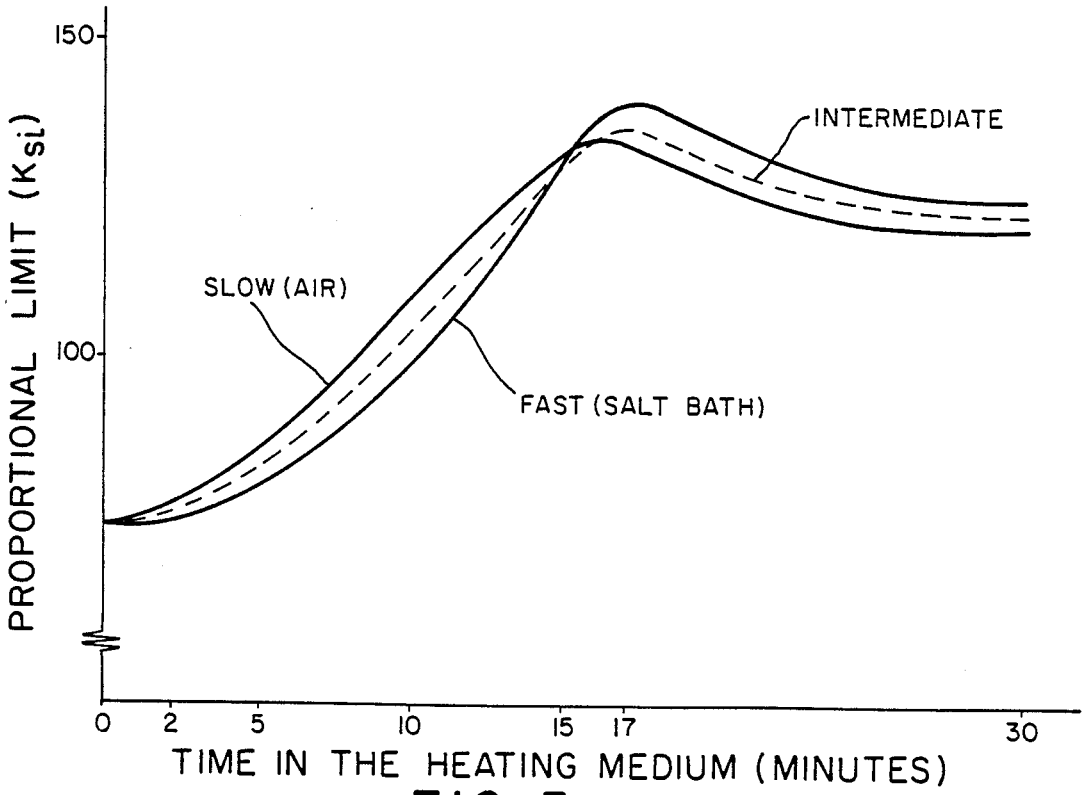
FIG. 3 is a plot of proportional limit versus time in the heating medium. This graph is described below in Example 1.

Reproducibly age hardenable specimens were heated to 600° F. in (1) air, to give a slow heating rate, (2) molten sale bath, to give a fast heating rate, and (3) in a molten salt bath but surrounded in a bundle by six steel specimens, to give an intermediate heating rate. FIGS. 2 and 3 show the effects of these different heating rates on the elongations and proportional limits obtained from these three sets of originally equivalent specimens. They show that increasing the heating rate improves these mechanical properties of the beryllium copper wire. A fast quench prevented further slow aging.

The elongation and proportional limit could only be measured and plotted for the time the specimens were in the salt pot. Therefore, it is evident that the relative dimensions of the specimen and of the salt pot have an effect on the rate of heat transfer and therefore on the relative shapes of these curves. This is important in commercial applications. Although differences in the crystallographic structure of the precipitates have been found for fast heat-ups, the important fact is that in this case, control of the heating rate with its resultant control in the rate of removal of residual stresses resulted in control of specific mechanical properties.

When reproducibly age hardenable specimens were given the standard anneal, air cooled to room temperature and then up quenched into the salt bath for 15 minutes, followed by a water quench, the resultant average proportional limit was 74.6 ksi as compared to 74.2 ksi for the original ¼ H wire. When reproducibly age hardenable specimens were annealed and then down quenched into the salt bath as taught by the Britton patent for 15 minutes before being water quenched the resultant average proportional limit was 80.9 ksi. In contrast, when age hardenable specimens were given two minutes in the salt bath, water quenched and then given 15 minutes in the salt bath before being water quenched, the resultant average proportional limit was 118.0 ksi. This is in comparison to 15 minutes in the salt bath which gave an average proportional limit of 131.5 ksi and 30 minutes in a salt bath which gave an average proportional limit of 124.6 ksi. It is apparent that the reduction in the magnitude of the residual stresses by the 2 minute stress relief treatment had the effect of decreasing the rate at which aging treatment precipitation hardens the reproducibly age hardenable wire. Then it is evident that decreasing the magnitude of the residual stresses present decreases the rate at which the G.P. zones and $\gamma''$ or $\gamma'$, $\gamma$ precipitates nucleate and grow. Until these results are correlated with the crystallographic structures developed, they cannot be fully understood.

EXAMPLE 2

To determine whether or not beryllium copper wires were sensitive to changes in strain rate, tensile tests were run on BeCu wires furnished by a commercial wire drawer. There are indications that this wire was drawn under conditions which tended to minimize the turbulence. The wires were provided in four conditions. These were: (1) New processing—double reductions and anneals, followed by ¼ H reduction. Wires were then aged in a salt bath for three minutes at 600° F. (2) New processing—as above. Wires were then aged in air for two hours at 600° F. (3) Old processing—standard single reduction and anneal followed by ¼ H reduction. Wires were then aged in a salt bath for three minutes at 600° F. (4) Old processing —as above. Wires were then aged in air for two hours at 600° F.

All wires were initially pulled at a strain rate of 0.00013 inch/inch/sec until an offset yield of 0.01% was observed. The pull was then halted and the load was released. The test was then resumed at a strain rate of 0.013 inch/inch/sec. Thus, a change in strain rate of a factor of 100 was employed. The strain rate sensitivity, m, was computed after measuring the change in flow stress, $\sigma$, caused by the change in strain rate, $\dot{\epsilon}$, in accord with the following equations.

$$\sigma = C \cdot \dot{\epsilon}^m \quad m = \frac{\log(\sigma_2/\sigma_1)}{\log(\dot{\epsilon}_2/\dot{\epsilon}_1)}$$

When these results were calculated over the offset yield range of 0.01% to 0.2%, it was evident that the double reduction process, particularly when combined with the salt bath treatment, showed the least sensitivity to changes in strain rate. That is, the treatment that minimizes the sensitivity to strain rate also minimizes distortion on aging and increases elongation. Furthermore, the strain rate sensitivity was greater for lengths given the slow heating in air than for those given the quick salt bath heating. The important conclusion to be derived from the results of these and other similar tests is that since the beryllium copper wire was in all cases found to be strain rate sensitive, we must consider the cold forming of all beryllium copper primary products as strain rate sensitive.

Since beryllium copper is strain rate sensitive, there must be a range of rates of metal flow for a specific geometry of the forming tools in which there is minimal turbulent metal flow. Then to form reproducibly age hardenable strip, rod, wire or tubing, there must be combinations of line speeds or extrusion rates and rates of reduction which minimize the turbulent flow for the specific tool geometry involved. The degree of turbulence is determined by the fact that aged segments will show minimal strain rate sensitivity in the 0.01% to 0.2% offset yield range. Those combinations that minimize the turbulent flow also minimize the three dimensional differences in the residual stress patterns set up by the turbulent flow. After reproducible aging conditions, the strain rate sensitivity can be calculated. Then it becomes possible by altering the line speed, reduction and tool geometry to determine those combinations that give minimal strain rate sensitivity and therefore minimal turbulent flow.

Similarly for stamping or shaping parts from such sheet, wire, rod or tubing, there should be rates of deformation for which the turbulent flow in the part is minimized and the change in shape made more reproducible. By reproducing the aging techniques on sample parts made at different rates from reproducibly age hardenable strip and comparing the resultant distortions, those rates that minimize the distortion can be determined.

It must be realized that total laminar flow is the most desirable condition. Yet, from a practical point of view, there are a range of combinations of tool geometries and reproducibly controlled rates of reductions, line speeds or extrusion rates that would be satisfactory. Such a range would be much smaller for zero defect needs than for some commercial applications.

EXAMPLE 3

To determine the magnitude of the effect of the double reduction technique on the mechanical properties of beryllium copper strip, two contiguous sections were taken from the same rolled coil of 25 alloy. The initial thermal and mechanical history of the coil was unknown. One section was reduced 45%, annealed and rolled to the ½ H condition. The other section was reduced 35%, annealed, reduced to a total reduction of 43%, annealed and rolled to the ½ H condition. All reductions were made at those slow line speeds which seem to give more laminar flow patterns. In this case, the test used was one of determining that line speed which gave the most uniform thickness after cold rolling. A comparison of tensile properties was made on specimens that were in the as-rolled, the annealed in argon and the aged in argon 3 hours at 600° F., conditions. It showed that in the as-rolled condition, the reproducibly age hardenable specimens showed slightly lower yields and ultimates as well as higher elongations. The average 0.01% and 0.2% offset yields of the reproducibly age hardenable materials in the as-rolled condition were at least 10% below that of the standard material while the average longitudinal and transverse elongations were over 30% greater.

Figure 4:
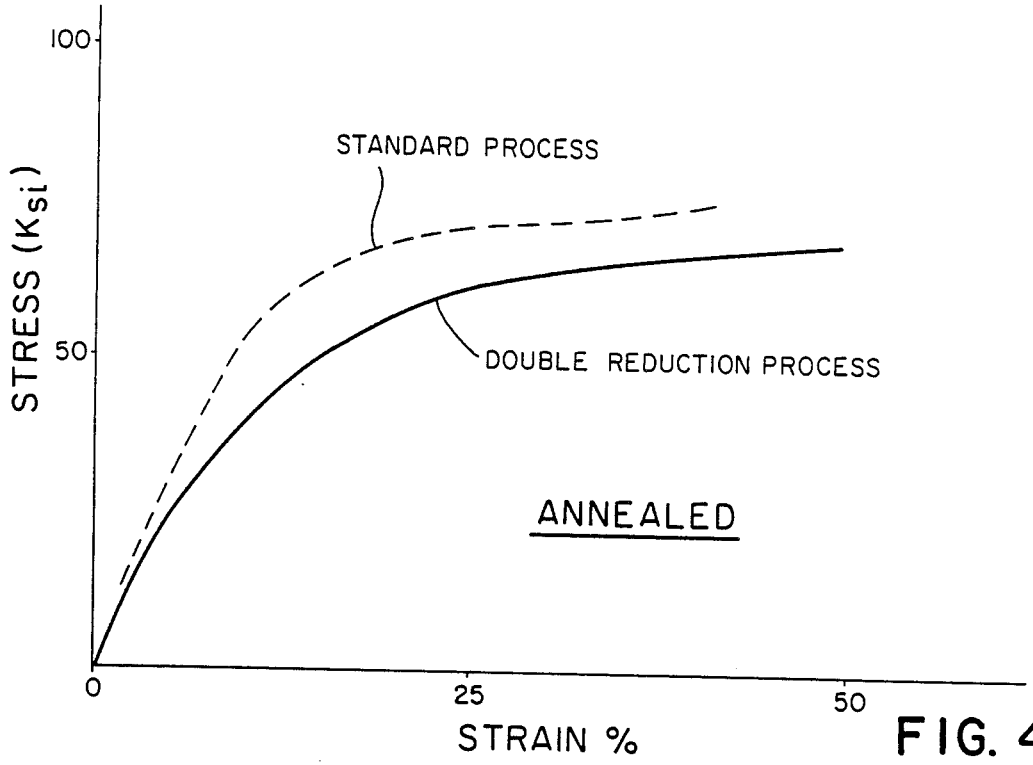
FIG. 4 is a plot of stress versus strain for annealed strip that had been given (a) the standard process treatment and (b) the double-reduction treatment described in Example 3.
Figure 5:
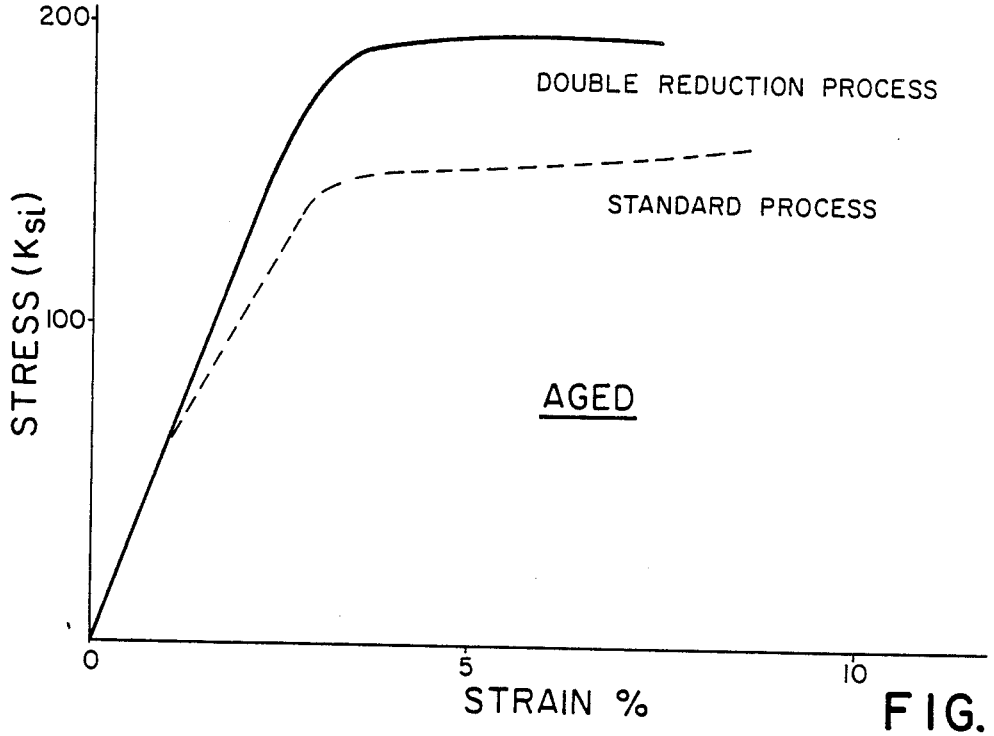
FIG. 5 is a plot of stress versus strain for aged strip that had been given (a) the standard process treatment and (b) the double reduction treatment described in Example 3.

Annealing the two materials resulted in the average 0.01% and 0.2% offset yields of the reproducibly age hardenable treated materials dropping at least 40% below that of the standard materials. However, aging for 3 hours at 600° F. resulted in the average 0.01% and 0.2% offset yields of the reproducibly age hardenable material being at least 20% higher than that of the standard material. This reversal in the relative positions of the offset yield values for strip in the standard and reproducibly age hardenable treated conditions was totally unexpected. It was found that when such strips were heat treated at intermediate temperatures their relative positions changed continuously with the temperature. Therefore, it became apparent that the relative positions were dependent not only upon the type of the precipitate structures created but also on the magnitude of the original residual stress and precipitate patterns present in the as-rolled strip that on aging created the differences in the rates of precipitation. Of interest to the design engineer was the pronounced reversal in the relative slopes of the stress-strain curves in the 0.01% to 0.2% range for the aged and annealed materials. This reversal in slopes means that it is possible to reproducibly control the initial rates of work hardening through selection of the proper thermal treatment for the mill hardened strip. This reversal in slopes is shown by a comparison of the stress-strain curves of FIGS. 4 and 5. This means that predictable and reproducible control of the fatigue life and stress relaxation properties can be obtained in parts formed from such mill hardened strip.

Since most commercially available grades of beryllium copper alloys contain cobalt beryllides, the effects of these beryllides on this invention must be considered. One of the effects of cobalt beryllides on the mechanical properties of a beryllium copper alloy is that the size and distribution of these cobalt beryllide precipitates, that can be controlled during the casting process, have an appreciable effect on the rate of work hardening. Therefore, cobalt beryllides must also have an effect on those combinations of time and temperature that are needed to stress relieve the alloys. Thus, it will be appreciated that in the application of this invention, times and temperatures may have to be adjusted to accommodate the particular size and distribution of cobalt beryllides in the alloy which one is processing.

In processes which include an operation such as slitting prior to forming, without using laser techniques, it will be necessary to stress relieve the alloy both before and after such an operation so as to avoid the detrimental effects of the deformations and stresses imparted into the alloy by the slitting operation. The stress relief process will require a molten heating medium in combination with specific times, temperatures and heating rates that relieve the magnitude of residual stresses before the formation of precipitates becomes the dominant mechanism. Such combinations of times and temperatures ±25° F. which have been found effective are 500° F. for a period of from twenty to sixty minutes, 600° F. for a period of from sixty to ninety second, and 700° F. for a period of from thirty to fifty seconds.

It should be noted that the incorporation of the stress relief anneals may require a light rolling reduction of up to 15% subsequent to the last stress relief anneal so as to impart some stiffness and the ability to be precipitation hardened into the alloy and thus facilitate its handling and feeding in subsequent operations. In those commercial operations where the conditions for zero defects are not needed, changing the amount of reduction will give mill hardened strip from which parts can be formed without further age hardening.

However, where there is need for higher strengths, for greater fatigue lifes, for improved stress relaxation properties or for improved mechanical properties at higher temperatures, the end users must age harden the parts under the conditions taught in this patent. It will be appreciated that the combinations of times, temperatures and heating rates set forth in this invention simply represent guidelines and that in light of the teachings of this invention one skilled in the art may derive a variety of functional times and temperatures. Additionally, the optimum combination of times and temperatures will be a function of numerous variables such as strip or wire configuration, heat sources, alloy composition, line speed, tool geometry, etc.

Finally, it will be appreciated that the application of only a portion of this invention will yield beneficial results; however, to assume zero defects optimum results will be achieved by incorporating all portions of the invention.

We claim:

1. In a method for cold working a beryllium copper alloy wherein the alloy is maintained at a heat treating temperature between about 300° F. and 800° F. for a time sufficient to reduce residual stresses therein and thereafter is quenched and brought to room temperature, the improvement of which comprises attaining the heat treating temperature before appreciable precipitation hardening takes place.

2. The method of claim 1 wherein the cold working of the alloy is done with minimal turbulence.

3. The method of claim 1 wherein the heat treating is done in a salt bath at 375°–800° F. for 2–20 minutes, and the alloy is quenched, then further precipitation hardened.

4. The method of claim 1 wherein the alloy is a strip that is cold rolled in a plurality of passes, each one with the faces being reversed from the previous cold rolling pass but with the leading end being the same.

5. The method of claim 1 wherein the heat treating is done at a temperature in excess of 425° F.

6. The method of claim 2 wherein the alloy is annealed at 1550°–1850° F. prior to the heat treating the alloy is then given a pair of cold working reductions, each followed by a solution anneal, the first reduction being in excess of 35%, the second reduction being between 5° and 15%, and the resulting product is work hardened by further cold working.

7. The method of claim 2 wherein the alloy is annealed at 1550°–1850° F. prior to its cold working, then cold worked and heat treated, the heat treat being conducted at 375°–775° F. for 30 seconds to 4 hours in a molten heating medium that provides a heat transfer coefficient of 150–750 BTU/ft$^2$/hour/°F. and the resulting quenched product is further work hardened by cold working to put it in a mill hardened condition.

8. The method of claim 2 wherein the alloy is a strip that is subjected to the heat treating at a temperature of 350°–625° F. for up to 30 minutes, then slit into narrower strip, and a narrower strip then is subjected to further heat treating at 350°–625° F. for up to 4 hours.

9. The method of claim 7 wherein the alloy is annealed at 1550°–1850° F. prior to the cold working, then cold worked and heat treated, the heat treatment being conducted at 375°–525° F. in an inert atmosphere for ⅓ to 4 hours followed by a quench for 30 seconds to 4 hours at 525°–775° F. in a molten heating medium that provides a heat transfer coefficient of 150–750 BTU/ft$^2$/hour/°F. then water quenched and the resulting quenched product is further work hardened by cold working to put it in a mill hardened condition.

10. The method of claim 8 wherein the narrower strip is mill hardened by further cold working.

11. The method of claim 9 wherein the cold working prior to the heat treating is done to effect at least a 91% reduction in the alloy thickness.

12. The method of claim 9 wherein the heat treating is done at 425°–525° F. for 2–6 hours.

13. The method of claim 12 wherein the heat treating of a narrower strip is done at 600°–775° F. for ⅓–4 hours prior to quenching.

14. The method of claims 6, 7, 9, 11 or 8 wherein the alloy product thereof is machined or otherwise reproducibly shaped into a part, and the part is subjected to the heat treating in a molten heating medium at a temperature of 375°–775° F. for up to 6 hours prior to quenching.

15. The method of claims 6, 7, 9, 11 or 8 wherein the heat treating is done at 600°–700° F. for 2–20 minutes prior to quenching.

16. The method of claim 14 wherein the heat treating of a part is done at 600°–775° F. for ⅓–4 hours prior to quenching.

* * * * *